US006080344A

United States Patent [19]

Thorbjörnsson

[11] Patent Number: 6,080,344

[45] Date of Patent: Jun. 27, 2000

[54] METHOD OF PRE-PRESSING FIBROUS MATERIAL DURING THE MANUFACTURE OF BOARD PRODUCTS

[75] Inventor: Sven-Ingvar Thorbjörnsson, Karlstad, Sweden

[73] Assignee: Sunds Defibrator Industries AB, Sweden

[21] Appl. No.: 09/142,425

[22] PCT Filed: Mar. 6, 1997

[86] PCT No.: PCT/SE97/00386

§ 371 Date: Sep. 4, 1998

§ 102(e) Date: Sep. 4, 1998

[87] PCT Pub. No.: WO97/32701

PCT Pub. Date: Sep. 12, 1997

[30] Foreign Application Priority Data

Mar. 7, 1996 [SE] Sweden ..... 9600901

[51] Int. Cl.[7] ..... B27N 3/18; B27N 3/24

[52] U.S. Cl. ..... 264/83; 264/102; 264/109; 425/371

[58] Field of Search ..... 264/83, 101, 102, 264/109; 425/371

[56] References Cited

U.S. PATENT DOCUMENTS

| | | | |
|---|---|---|---|
| 5,063,010 | 11/1991 | Fischer et al. | 264/109 |
| 5,433,905 | 7/1995 | Tisch | 264/83 |
| 5,711,972 | 1/1998 | Schedin et al. | 425/363 |

FOREIGN PATENT DOCUMENTS

94/26488 11/1994 WIPO .

*Primary Examiner*—Mary Lynn Theisen
*Attorney, Agent, or Firm*—Lerner, David, Littenberg, Krumholz & Mentlik, LLP

[57] ABSTRACT

Methods for prepressing lignocellulose-containing fibrous material are disclosed including forming a lignocellulose-containing fibrous material into a web, initially compressing the web and permitting expansion of the web, recompressing the web in an entry section of a prepress to a density proximating that of the density of the initially pressed web, permitting the recompressed web to undergo controlled expansion in an expansion section of the prepress, injecting steam into the web within either the entry or expansion sections of the prepress, and transferring the expanded web into a finishing press.

5 Claims, 1 Drawing Sheet

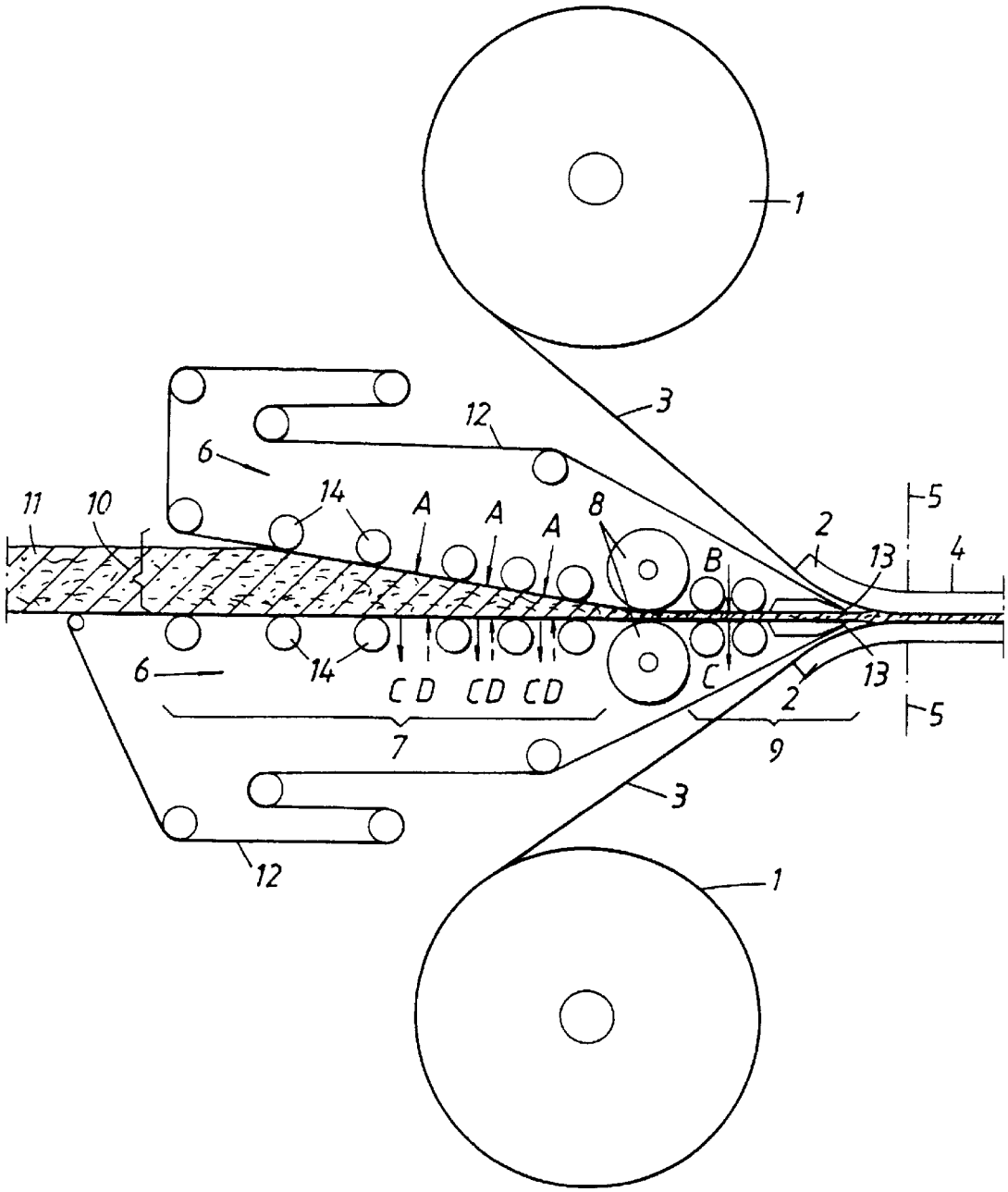
1
3
12
6
11
10
14
A
A
A
8
B
2
13
4
5
6
14
C D
C D
C D
C
2
13
5
7
9
3
12
1

METHOD OF PRE-PRESSING FIBROUS MATERIAL DURING THE MANUFACTURE OF BOARD PRODUCTS

FIELD OF THE INVENTION

The present invention relates to a method for prepressing a formed web of finely-divided lignocellulosic fibrous material prior to finish-pressing the web in the continuous manufacture of board products.

BACKGROUND OF THE INVENTION

During the manufacture of different types of board products, a web or mat is generally formed which is prepressed prior to being passed into the heat press, in which the web or mat is pressed under a controlled surface pressure and/or controlled thickness at a temperature of between about 150 and 230° C., while simultaneously applying glue. In order to obtain the requisite board properties, a continuous press is required which is flexible and with which a high surface pressure, among other things, can be applied during an early stage in the press. Thus, the thickness of the web or mat should be very close to the final press thickness even at this early stage of the process, i.e. the mat thickness must be very greatly reduced in the press entry section.

It is desired to avoid excessive pre-hardening of the surface layers without the risk of surface bulging or cracking in the material, due to enclosed air being rapidly pressed out. It has therefore been proposed in Swedish Patent No. 502,202 that subsequent to forming the fibrous material into a web, with subsequent first compression and expansion of the web, the web is successively recompressed in the entry section of a prepress to a density close to the density of the web after the first compression, and that the web is then transferred to the finishing press while controlling limited expansion of the web in the prepress expansion section.

An object of the present invention is to further improve this method, so as to enable the use of a shorter and less expensive hot press and to reduce the power requirement of the press.

SUMMARY OF THE INVENTION

In accordance with the present invention, this and other objects have now been accomplished by the invention of a method of prepressing lignocellulose-containing fibrous material which comprises forming the lignocellulose-containing fibrous material into a web, initially compressing the web to a first density and permitting expansion of the initially compressed web, recompressing the initially compressed web in an entry section of a prepress to provide a recompressed web having a second density approximating the first density, permitting the recompressed web to undergo controlled expansion to provide an expanded web in an expansion section of the prepress, injecting steam into the web within at least one of the entry and expansion sections of the prepress, and transferring the expanded web into a finishing press.

In accordance with one embodiment of the method of the present invention, the web includes an upper side and a lower side, and the method includes injecting the steam into the upper side of the web and withdrawing the steam from the lower side of the web.

In accordance with another embodiment to the method of the present invention, the web includes an upper side and a lower side, and the method includes injecting the steam into the upper side of the web in the entry section of the prepress, and injecting the steam into the lower section of the web in the entry section of the prepress. In a preferred embodiment, the method includes injecting the steam into the web in an expansion section of the prepress.

In accordance with another embodiment to the method of the present invention, the method includes injecting air into the web along with the steam.

BRIEF DESCRIPTION OF THE DRAWING

The invention can be more fully appreciated with reference to the following detailed description, which, in turn, refers to the drawing which is side elevational schematic representation of an apparatus for application of the method of the present invention.

DETAILED DESCRIPTION

Referring to the drawing, the entry section of a continuous hot press is shown therein, which typically includes front deflecting rollers 1 and hot plates 2. These hot plates 2 have an inlet radius on the same order of magnitude as the radius of the deflecting rollers 1, the hot plates 2 merging with a generally rectilinear, parallel section 4. A steel band tensioned over deflecting and driving rollers slides or rolls on the hot plates 2. The transition between the entry radius and the parallel section 4 is marked with the center line 5, i.e., the line between the centers of curvature of the press entry section.

A prepress 6 is mounted in this entry section. The prepress comprises three main parts: a convergent entrance and compression part 7, one or more pairs of roll nips 8, and a slightly divergent expansion section 9. The entry opening 10 of the entry section can be adjusted in a convenient manner, either automatically or manually, so as to be adapted to the height or thickness of the incoming fibrous mat 11. This, together with an entry section of suitable length, enables air to be pressed from the mat 11 in a gentle manner without risk of damage. The upper, vertically movable nip roll 8 is suitable loaded in a manner to compress or compact the mat 11 to the extent desired. In this regard, the mat is preferably compressed to a density close to and preferably immediately beneath the density that was achieved in the previous compression process after forming. Such recompression requires a relatively moderate load. The load is conveniently applied with the aid of pneumatic or hydraulic piston-cylinder devices or the like. The end of the entry section 7 closest to the upper nip roll 8 is suitably connected mechanically to the nip roll so as to follow the vertical movements of the nip roll.

The mat is allowed to expand slightly, e.g. to an extent corresponding to about 5 to 15%, in the downstream divergent expansion section 9, this force thus reducing the force required to keep the mat compressed. This enables this section to be given moderate dimensions. The ends of the expansion section 9 nearest the nip rolls 8 are also suitably mechanically coupled to their respective nip rolls.

The mat 11 is transported through the prepress between two endless belts 12, which may be solid, air-permeable or in the form of wires. The bands are supported in the entry section 7 on rollers 14 and/or slide surfaces. The belts are deflected at the outlet end of the expansion section 9 around a slide nose or on rollers. The belts 12 are driven and guided in a known manner. If considered appropriate in view of the forces acting on the belts in the entry section 7 and the nip rolls 8, a stronger, inner belt may be used.

Hitherto, the prepress 6 has operated in the absence of heating and this method has therefore been designated "cold entry." However, according to the present invention, the mat is heated, preferably to a temperature of between abut 50 and 80° C., with the aid of steam. The mat is heated by blowing steam into the entry section 7, as indicated by arrows A, and/or into the expansion section 9, indicated by arrow B. It is also feasible to blow-in a mixture of air and steam. This also enables the moisture content of the web or mat to be regulated and restricted.

According to a first alternative of the present invention, a regulated flow of steam is blown, or injected, solely into one location in the prepress and drawn from the web on the underside of the press, as indicated by arrows C. This can be achieved with the aid of a short steam box on the upper side of the press web and a suction box on the underside thereof. Such boxes need only have a length of about 50 centimeters. Steam rollers may be used as an alternative to steam boxes, for instance, wherein the support rollers 14 may also function as steam rollers. When injecting a mixture of air and steam, the volume of the air/steam mixture drawn from the press web is adapted so as to control the pressure in the web.

The advantages afforded by such steam injection reside firstly in a much shorter press time in the downstream hot press, because the fibrous mat has already been heated through to a temperature of about 80° C., and because the heating balance required to heat the mat to about 110° C. only requires a fraction of the normal power. This enables the hot press to be made much shorter and thus much more cheaply, and the capacity of an existing longer hot press is greatly improved. Secondly, the mat is compressed more easily as a result of heating the mat and as a result of the slightly higher moisture quotient, thereby reducing the power requirement in the subsequent hot press. Thirdly, the resiliency of the mat in the transition between the prepress and the entry to the hot press decreases. Fourthly, the density profile can be configured, by virtue of the fact that a stronger press force can be applied directly in the hot press.

According to a second alternative of the present invention, steam or an air/steam mixture is injected into both the entry sections 7 and the expansion section 9, in accordance with arrows A and B. In this case, steam is suitably injected into the entry section from both directions, thus also in accordance with the broken arrows D. The steam flow is adapted so that only the surface layers of the web or mat are moistened and heated. This results in heavy compression of the surface layers in the nip. When desiring a much shorter press time, the center layer may be heated in the expansion section. In this regard, it may be unnecessary to inject steam into the expansion section 9, since the moist surface layer has a steam rejecting effect in the hot-pressing process, therewith shortening the press time. The compressed surface layer also facilitates achievement of the desired density profile.

In the earlier known "cold entry," expansion of the fibrous mat is restricted and the risk of blow-out in the hot press entry is avoided and pre-hardening thereby reduced. The injection of steam carried out in accordance with the present invention also reduces the requisite press force in the prepress 6 and greatly reduces resiliency in the expansion section. The mat is also heated, which enables a shorter hot press to be used.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method of prepressing lignocellulose-containing fibrous material comprising forming said lignocellulose-containing fibrous material into a web, initially compressing said web to a first density and permitting expansion of said initially compressed web, recompressing said initially compressed web in an entry section of a prepress to provide a recompressed web having a second density approximating said first density, permitting said recompressed web to undergo controlled expansion to provide an expanded web in an expansion section of said prepress, injecting steam into said web within at least one of said entry and expansion sections of said prepress, and transferring said expanded web into a finishing press.

2. The method of claim 1 wherein said web includes an upper side and a lower side, and including injecting said steam into said upper side of said web and withdrawing said steam from said lower side of said web.

3. The method of claim 1 wherein said web includes an upper side and a lower side, and including injecting said steam into said upper side of said web in said entry section of said prepress, and injecting said steam into said lower side of said web in said entry section of said prepress.

4. The method of claim 3 including injecting said steam into said web in said expansion section of said prepress.

5. The method of claim 1 including injecting air into said web along with said steam.

* * * * *

UNITED STATES PATENT AND TRADEMARK OFFICE

CERTIFICATE OF CORRECTION

PATENT NO. : 6,080,344
DATED : June 27, 2000
INVENTOR(S) : Thorbjornsson

It is certified that error appears in the above-identified patent and that said Letters Patent is hereby corrected as shown below:

Title Page,
Item [54] "PRE-PRESSING" should read --PREPRESSING--.

Column 1,
Line 1, "PRE-PRESSING" should read --PREPRESSING--.

Signed and Sealed this

Tenth Day of July, 2001

Nicholas P. Godici

*Attest:*

*Attesting Officer*

NICHOLAS P. GODICI
*Acting Director of the United States Patent and Trademark Office*